US007143930B2

(12) United States Patent
Money et al.

(10) Patent No.: US 7,143,930 B2
(45) Date of Patent: Dec. 5, 2006

(54) CARTONS FOR SANDWICHES OR LIKE FOODSTUFF

(75) Inventors: Julian David Kyrle Money, Richmond (GB); Savv Akis Sayya, London (GB)

(73) Assignee: Rapid Action Packaging Limited (GB)

( * ) Notice: Subject to any disclaimer, the term of this patent is extended or adjusted under 35 U.S.C. 154(b) by 0 days.

(21) Appl. No.: 10/732,426

(22) Filed: Dec. 10, 2003

(65) Prior Publication Data

US 2004/0134810 A1 Jul. 15, 2004

(30) Foreign Application Priority Data

Dec. 10, 2002 (GB) ..... 0228792.8
Jul. 24, 2003 (GB) ..... 0317365.5

(51) Int. Cl.
*B65D 5/20* (2006.01)

(52) U.S. Cl. ..... 229/115; 229/117.01; 229/208; 229/243; 229/906; 229/938

(58) Field of Classification Search ..... 229/115, 229/207, 208, 243, 117.01, 902, 906, 938; 206/551

See application file for complete search history.

(56) References Cited

U.S. PATENT DOCUMENTS 662,969 A * 12/1900 Roth ..... 229/115
1,221,785 A * 4/1917 Williams ..... 229/115
1,664,111 A * 3/1928 Johnson ..... 229/115
2,107,946 A * 2/1938 Inman ..... 229/115
2,913,161 A * 11/1959 Travis ..... 229/115
3,142,430 A * 7/1964 Meyers ..... 229/240
3,250,454 A * 5/1966 Steiger ..... 229/115
3,428,235 A * 2/1969 Randazzo ..... 229/115
4,312,451 A * 1/1982 Forbes, Jr. ..... 229/208
4,313,542 A * 2/1982 Roberts et al. ..... 229/115
4,477,014 A * 10/1984 Brandenburger ..... 229/115
5,326,022 A * 7/1994 Green ..... 229/902
6,360,941 B1 * 3/2002 Larsson ..... 229/115
6,431,365 B1 8/2002 Money
6,695,202 B1 * 2/2004 Miess ..... 229/115

FOREIGN PATENT DOCUMENTS

DE 299 03 316 5/1999

(Continued)

OTHER PUBLICATIONS

International Search Report; PCT/GB 03/05414; H. Segerer; Mar. 15, 2004.

*Primary Examiner*—Gary E. Elkins
(74) *Attorney, Agent, or Firm*—Fish & Richardson P.C.

(57) ABSTRACT

The disclosure relates to a carton for a diagonally cut sandwich or like foodstuff formed from a blank of card and having triangular end walls connected by rectangular side walls to form a triangular prism-shaped container. One side wall of the container is hinged to another wall of the container to provide an opening for insertion/removal of foodstuff and to form a lid for closing the opening. The edges of the opening have out-turned flanges and the periphery of the lid overlies the out-turned flanges encircling the opening when the lid is in the closed position whereby the lid can be bonded to the flanges to seal the contents of the carton.

8 Claims, 15 Drawing Sheets

FOREIGN PATENT DOCUMENTS

| | | | | |
|---|---|---|---|---|
| GB | 1 019 065 | | 2/1966 | |
| GB | 1 313 950 | | 4/1973 | |
| GB | 2043595 A | * | 10/1980 | ..... 229/115 |
| GB | 2221449 A | * | 2/1990 | ..... 229/115 |
| GB | 2349634 A | | 8/2000 | |
| GB | 2 377 421 | | 1/2003 | |
| GB | 2 386112 | | 9/2003 | |
| WO | WO99/25618 A | | 5/1999 | |
| WO | WO 02/34629 | | 5/2002 | |

* cited by examiner 26
26
15
35
15
13

CARTONS FOR SANDWICHES OR LIKE FOODSTUFF

BACKGROUND OF THE INVENTION

1. Field of the Invention

This invention relates to cartons for diagonally cut sandwiches or like foodstuff.

2. Background Prior Art

Our European Patent Publication No. 532531 discloses a container for foodstuff formed from a blank card and having triangular end walls connected rectangular side walls to form a triangular prism-shaped container. One side wall of the container is hinged to another wall of the container to provide an opening for insertion/removal of foodstuff and to form a lid for closing the opening. The edges of the lid and the edges of the container extending from the hinge have integral tabs with a fold line at the hinge whereby the tabs fold inwardly beneath the lid as it is closed over the opening to assist in retaining foodstuff in the container.

Where the carton is used for perishable foodstuffs such as sandwiches, the shelf life of the carton is restricted to 2–3 hours to ensure that the sandwiches purchased by the consumer are acceptably fresh.

Where the sandwiches or other food item are perishable and it is required to have a longer shelf life, it is necessary to provide a hermetically sealed package for the foodstuff which is usually flushed with an inert gas such as nitrogen. Hermetically sealed packaging for such food items is usually formed from plastics materials and food products contained in such packaging can have a shelf life of 2–3 days or even several weeks. Plastics packaging is commonly formed from PVC which is not biodegradable and many retailers are reluctant to use such materials because of their long term environmental problems and consequently the poor image of the product which results.

It is an object of the present invention to provide a pack for a sandwich or other food item which is as easy and convenient to use as the sandwich pack disclosed in our European Patent Publication No. 1032531, which can be hermetically sealed to minimize deterioration of the food product contained in the package over an extended shelf life period and which is formed from wholly biodegradable material.

SUMMARY OF THE INVENTION

This invention provides a carton for a diagonally cut sandwich or like foodstuff formed from a bank of card and having triangular end walls connected by rectangular side walls to form a triangular prism-shaped container, one side wall of the container being hinged to another wall of the container to provide an opening for insertion/removal of foodstuff and to form a lid for closing the opening; wherein the edges of the opening have out-turned flanges, and the periphery of the lid overlies the out-turned flanges encircling the opening when the lid is in the closed position whereby the lid can be bonded to the flanges to seal the contents of the carton.

For example, the carton may be formed from a heat sealable card whereby the periphery of the lid of the container can be bonded by heat sealing to the out-turned flanges encircling the opening to the container.

Alternatively the periphery of the lid of the container may be bonded by adhesive to the out-turned flanges encircling the opening into the container.

In any of the above arrangements the lid may be formed with a projecting tab extending beyond the out-turned flanges of the opening into the container to enable the lid to be separated from the out-turned flanges to which it is bonded to open the container.

Also in any of the above arrangements the lid may be hinged to the base of one of the triangular end walls, the adjacent side walls and opposite end wall of the container having out-turned flanges with which the periphery of the lid can be bonded.

In the latter case a corner of the lid remote from the hinge to the triangular end wall may be formed with a projecting tab to be grasped for opening the lid.

In a further construction according to the invention the lid may be hinged to one side wall of the container and the adjacent triangular end walls and opposite side wall have out-turned flanges to which the periphery of the lid is bonded to seal the contents of the container.

In the latter case said opposite side wall of the container may have an extended flap and the end of the lid opposite the hinge to the side wall of the container has a corresponding tab which is bonded to the flap on the side wall to seal the carton and which can be used to tear the lid open from the container.

More specifically the tab at the end of the lid may be formed with a tear strip which is not bonded to the flap on the adjacent side wall of the container so that the tear strip can be readily detached from the remainder of the flap and used to tear the lid open.

In any of the above arrangements the lid may have a window extending at least part of the length of the lid with a clear plastics film extending across the window and sealed to the underside of the lid to enable the contents of the container to be viewed.

Also in any of the above arrangements the triangular side walls of the carton may have fold lines extending from the apices thereof to the opposing bases to enable the container to be folded flat for storage prior to use.

In the case where the lid is hinged to one triangular side wall of the container, the fold lines may extend through that side wall to enable the side wall to be folded flat is extended through the lid to enable the lid to fold flat with the side wall.

In accordance with a further feature of the present invention the tab on the lid hinged to one end wall and the tabs on the flanges on the other end wall of the container are not heat sealed together but are maintained separable for the user to grasp with separate hands to pull apart and to tear the lid away from the flanges encircling the opening breaking the heat seal between the lid and flanges to allow access to the sandwiches or other food product in the container.

BRIEF DESCRIPTION OF THE DRAWINGS

The following is a description of some specific embodiments, reference being made to the accompanying drawings in which.

DESCRIPTION OF THE DEFERRED EMBODIMENTS

Figure 1:
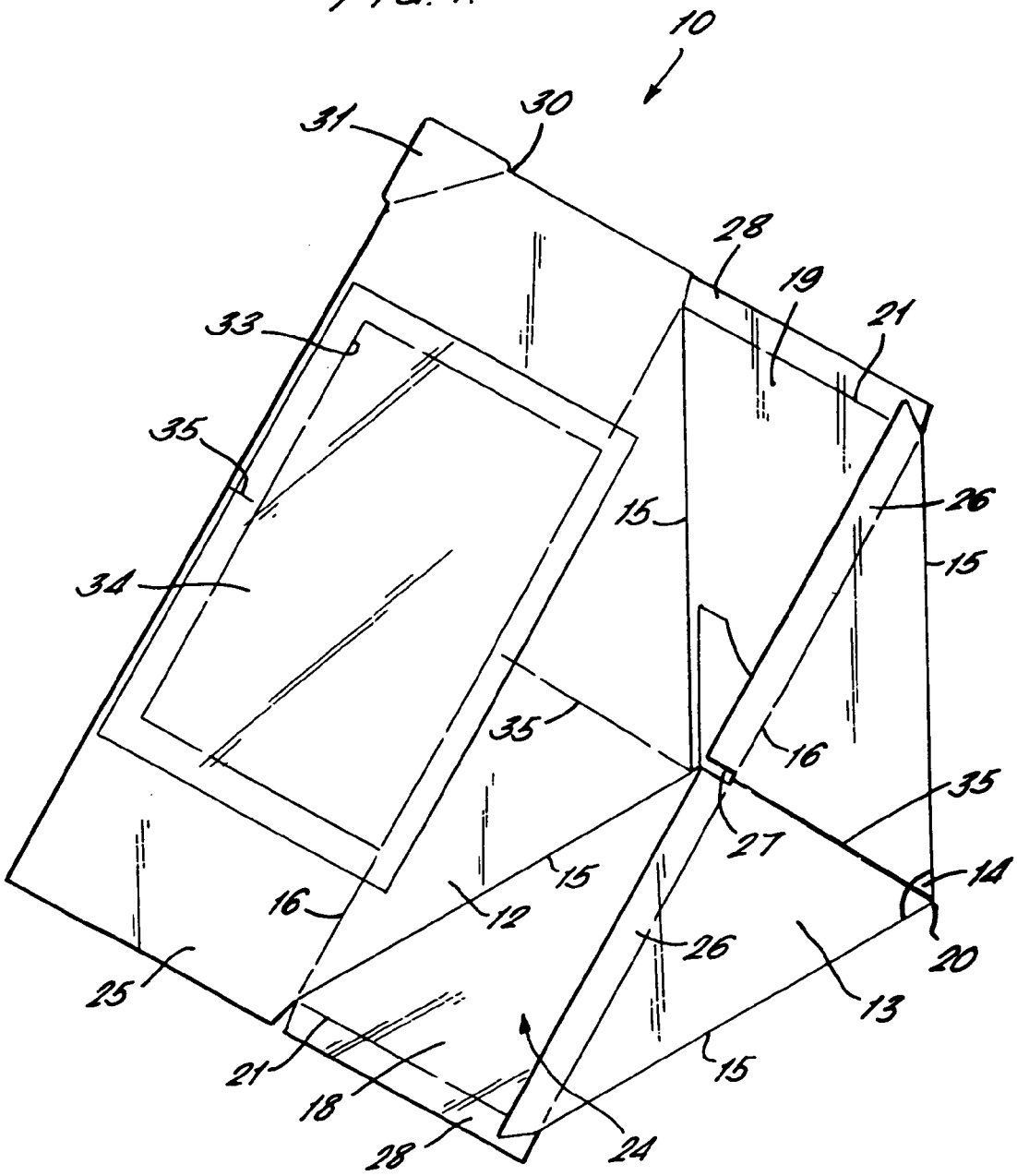
FIG. 1 is a front perspective view of a sandwich container in accordance with the invention with the lid of the container in the open position and the end walls of the container flat.

Referring first to the embodiments of FIGS. 1 to 4, there is shown a triangular prism-shaped cardboard container indicated generally at 10 for holding a diagonally cut round of sandwiches. The container is formed from a one-piece blank of a heat sealable card such as 400 micron folding boxboard (FBB) with a 15 gram polyethylene coating on its inside face to facilitate heat sealing. Alternatively the boxboard may have a polyester coating to facilitate heat sealing. Other packaging boards are also suitable such as solid bleached SBS with a grease resistant coating such as polypropylene, acrylic or the like. The container has two isosceles triangle shaped end walls 12, 13 having right-angled apices 14, equal length side edges 15 and base edges 16. The end walls 12, 13 are spaced apart by rectangular side walls 18, 19 extending along the side edges 15 of the end walls. The side walls 18, 19 of the container are joined at the apex 20 of the container and at their other ends have end edges 21 which, together with the base edges 16 of the end walls define a rectangular opening 24 in the base of the container for insertion and removal of a diagonally cut sandwich or similar food item.

The opening 24 is closable by a lid 25 hinged along one base edge 16 to overlie the opening 24. The other base edge 15 has an out turned integral flange 26 with a central split 27 and the adjacent end edges of the side walls 18, 19 have out turned flanges 28. In the closed position of the lid, the periphery of the lid overlies the flanges 26 and 28 and is heat sealed to the flanges using dies at 210° C. and at 80 p.s.i. pressure for a 1 second dwell time to provide a hermetic closure to the carton.

Sandwich containers are opened, filled and sealed using a machine which has jigs formed with pockets to hold packs open. A sandwich is placed in a pack. The pack is then indexed to a flange breaking station where the flanges around the opening to the container are turned outwardly ready to receive the lid. The lid is then closed and heat applied using dies via a heated compression plate to close and seal the lid. The pack is then ejected.

One corner 30 of the lid spaced opposite the hinge line to the end wall is formed with a projecting triangular tab 31 which is not heat sealed to the flanges and which can be lifted to separate the lid from the flanges when it is desired to open the carton.

The lid of the carton has a large rectangular central aperture 33 over which a strip 34 of the film is extended secured to the inside of the lid to provide a window for viewing the contents of the container.

The end walls of the container are formed with fold lines 35 extending from the apices of the walls to the base edges of the walls. In the case of the end wall to which the lid is hinged, the fold line extends through the lid. The fold lines enable the carton to be folded flat prior to use. When erected, the crease lines in the end walls/lid cause the end walls to bow outwardly shown in FIG. 2 to enable the operator to insert the sandwich in the carton and, equally, to enable the consumer to remove the sandwich from the carton.

Figure 4:
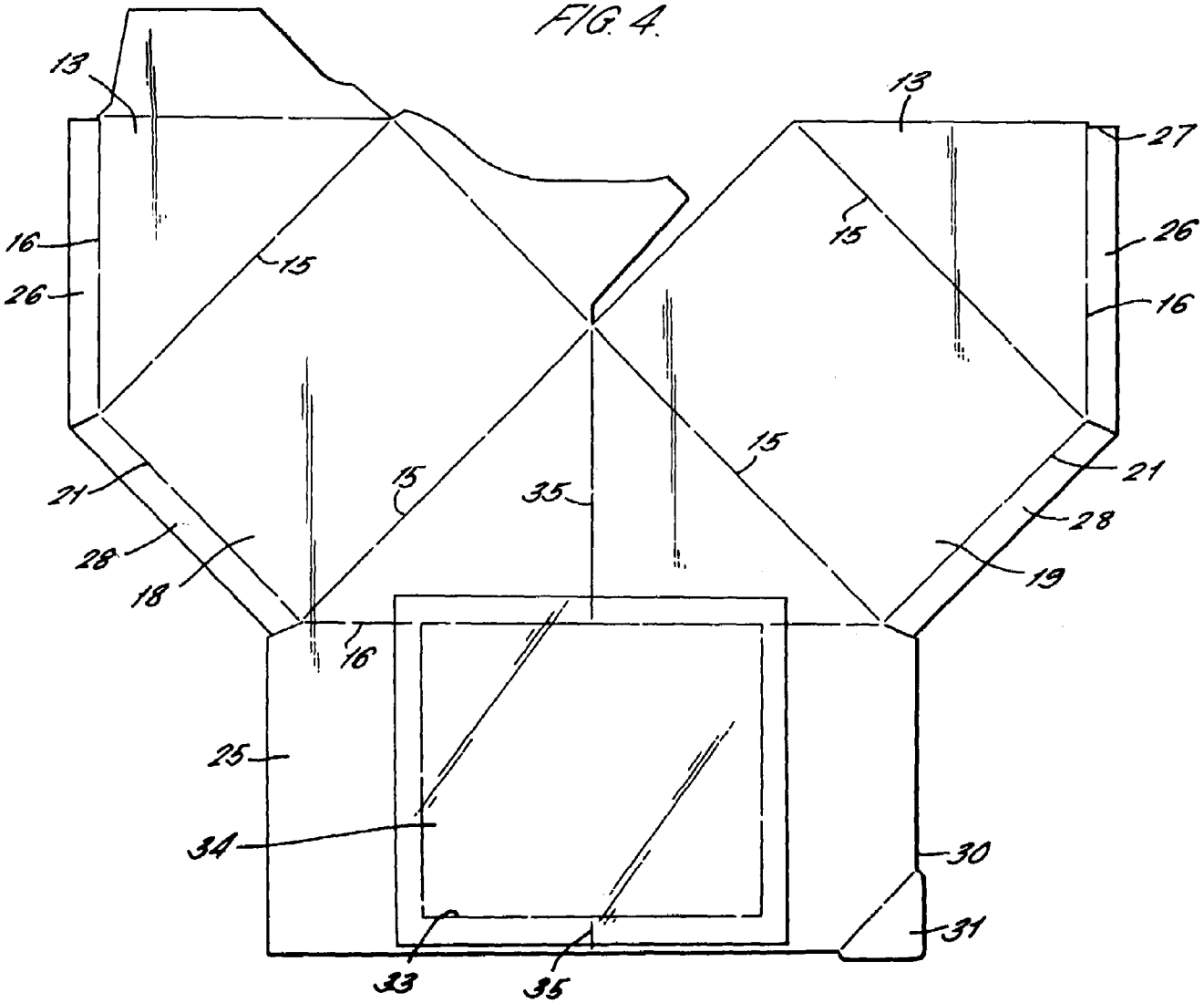
FIG. 4 is a plan view of a blank from which the container of FIGS. 1–3 is formed.
Figure 5:
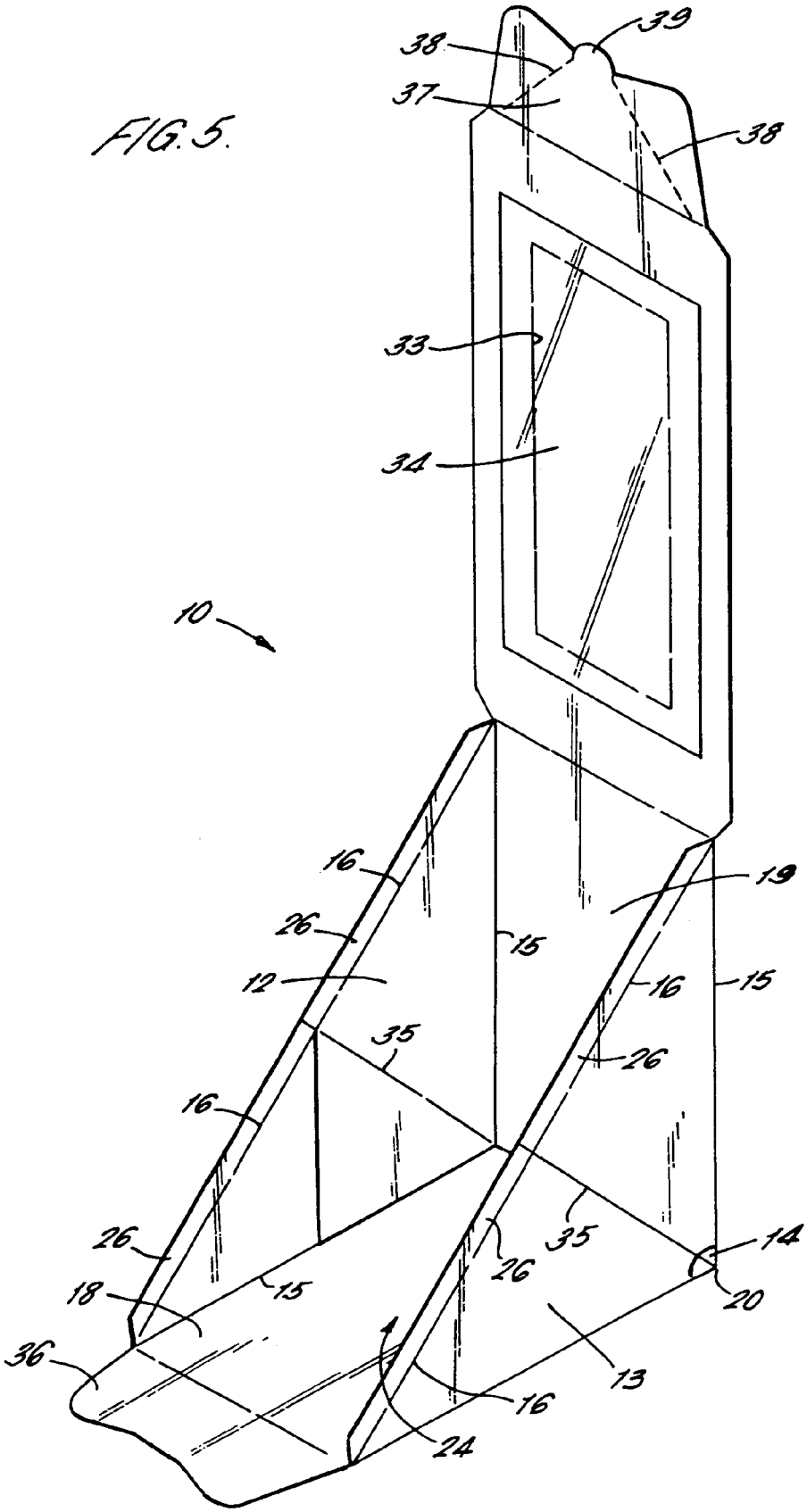
FIG. 5 is a front perspective view of a modified container shown with the lid open and the end walls of the container flat.
Figure 6:
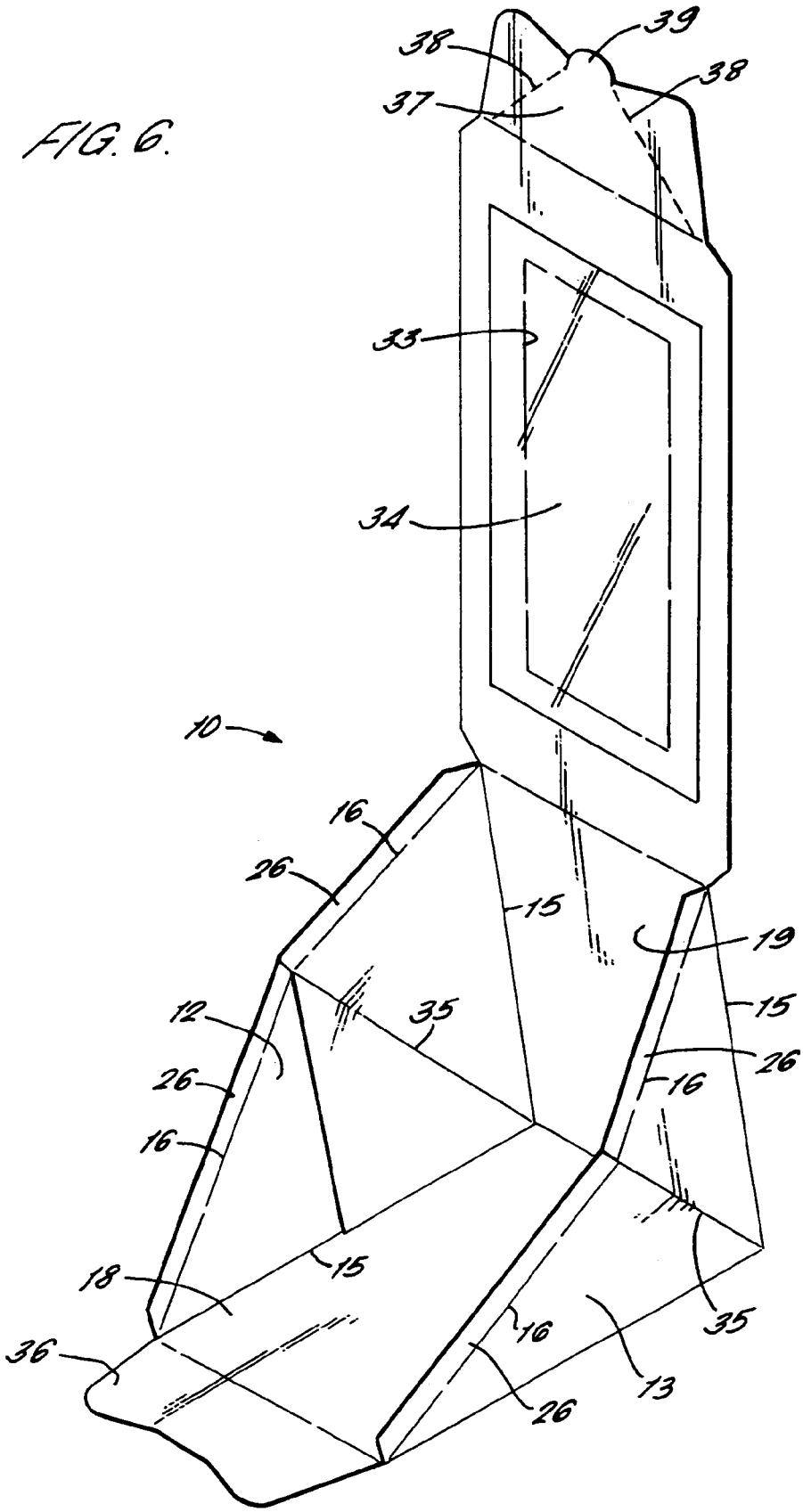
FIG. 6 is a similar view to FIG. 5 with the lid in the open position and the end walls of the container bowed.
Figure 7:
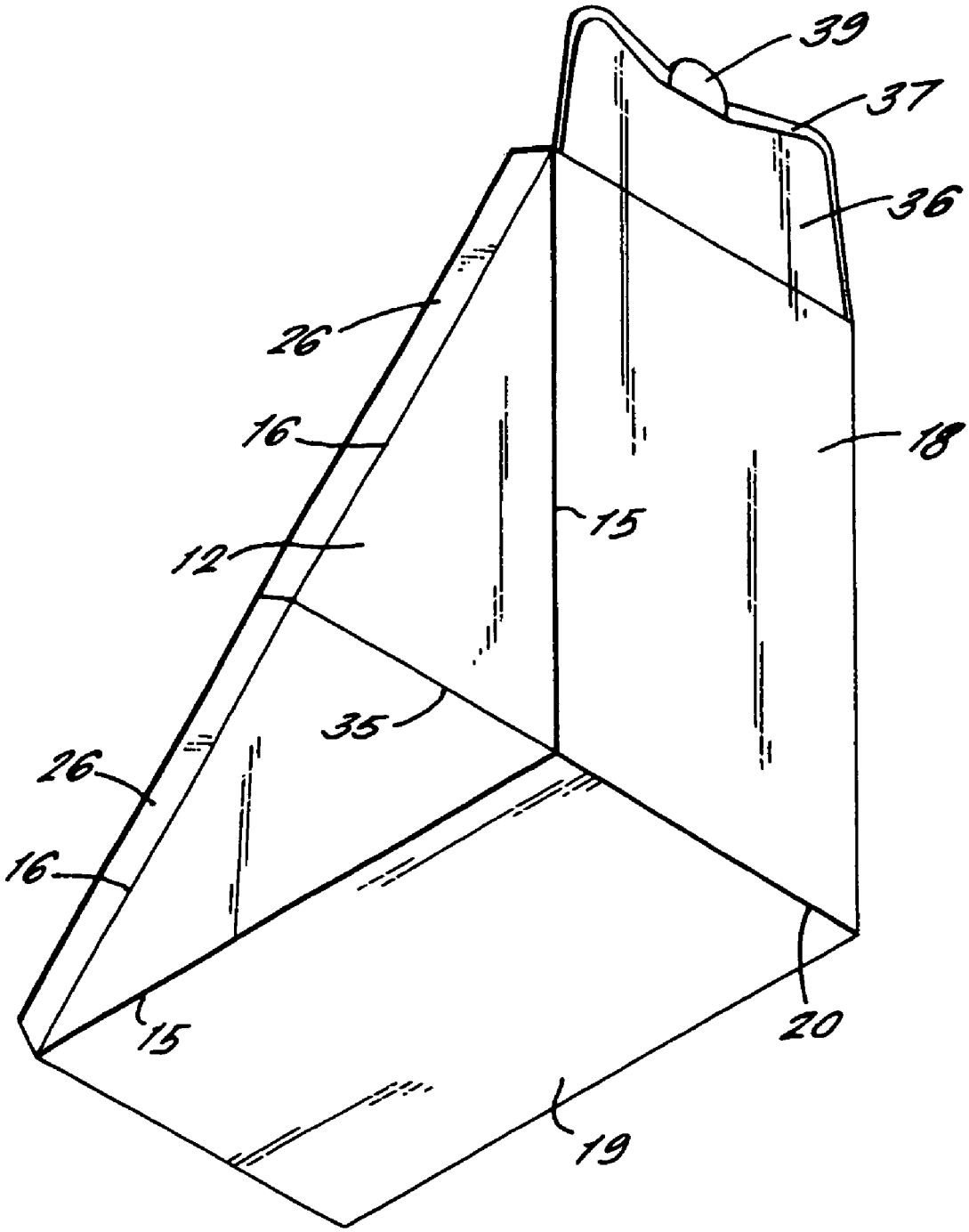
FIG. 7 is a rear perspective view of the container of FIGS. 5 and 6.
Figure 8:
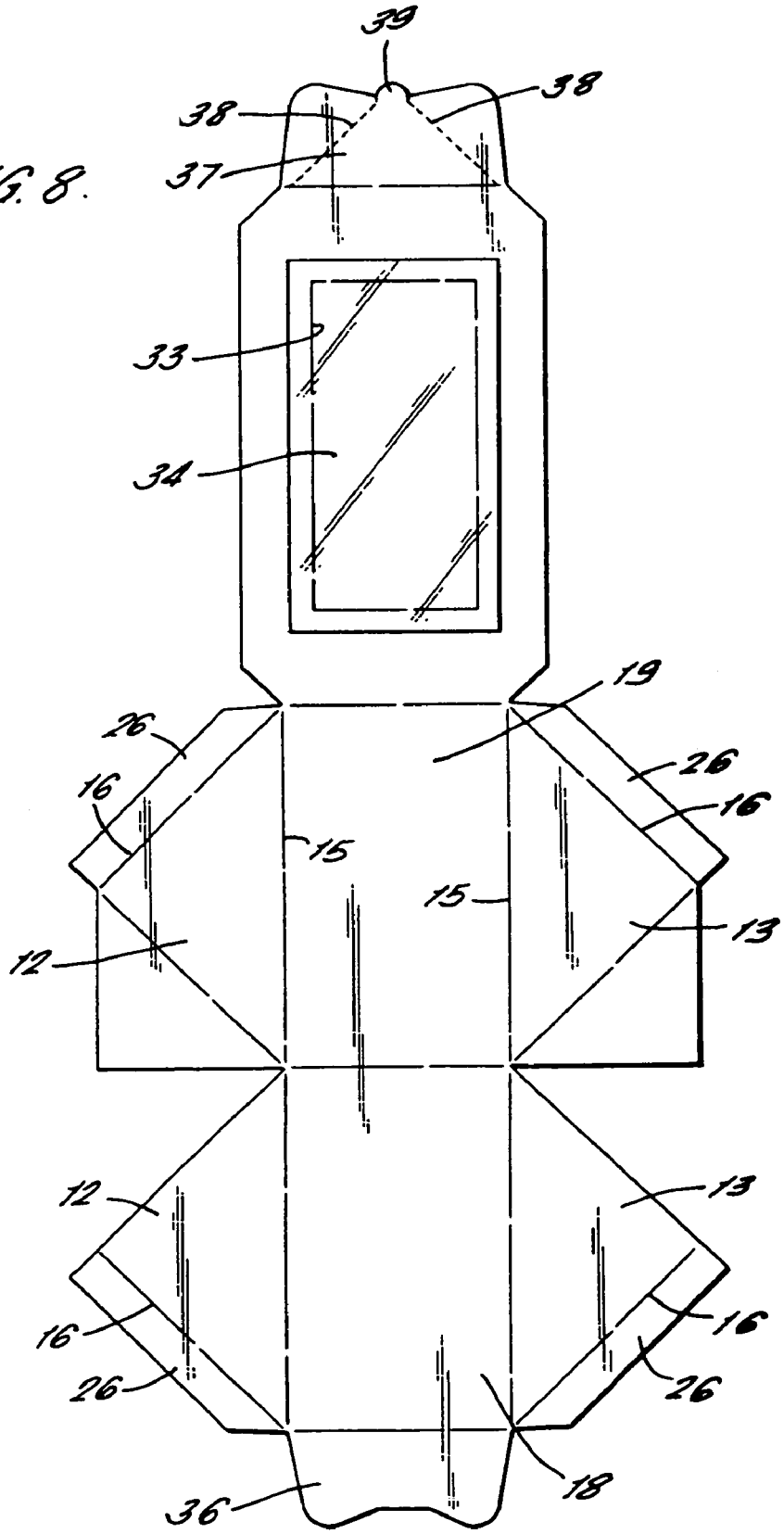
FIG. 8 is a plan view of a blank of the container from which the container of FIGS. 5 to 8 is formed.

FIG. 4 of the drawings shows the one piece blank from which the carton is formed.

Referring now to FIGS. 5 to 8, a similar carton is formed except that in this case the lid is hinged to one side wall and the opposite side wall is formed with an enlarged flap 36 with which a corresponding tab 37 on the free end of the lid seals. The base edges of the end walls of the carton have out turned flanges and the periphery of the lid overlies the base edges to be heat-sealed along with the tabs to provide a hermetically sealed closure as before. The tab 37 on the lid has convergent lines 38 of perforation extending to a central projection 39 and the central section of the tab is not heat-sealed or otherwise adhered to the corresponding flap on the body of the container. The central part of the tab is therefore readily severed from the remainder of the tab and can be used to lift the lid away from the body of the container severing the sealing of the lid to the out turned flanges of the end walls of the container.

Figure 9:
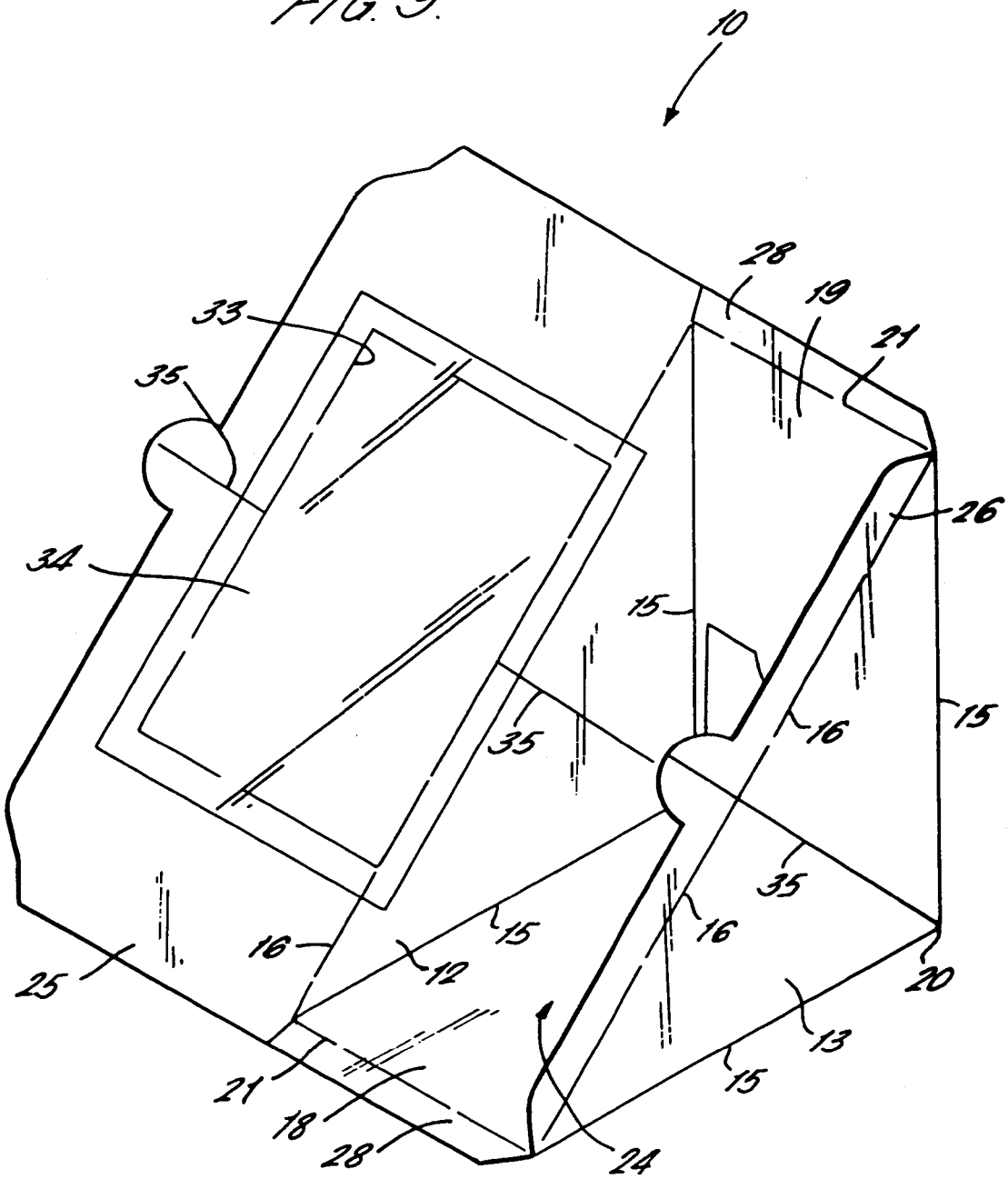
FIG. 9 is a perspective view of a further modified container similar to the container of FIG. 1.

Finally FIG. 9 shows a similar carton to that of FIGS. 1 to 4 except that the tab for releasing the lid from the out-turned flanges encircling the opening to the carton is formed at the centre of the lid and overlies and is heat-sealed to a corresponding tab on the opposing flanges on the base edge of the carton. The arrangement is otherwise as previously described.

It will be appreciated that many modification may be made to the blank and the procedure for erecting the sandwich container without departing from the scope of the invention. For example, instead of using heat sealable card for the container, ordinary card may be used and the lid adhered to the flanges of the opening by a suitable adhesive.

Figure 10:
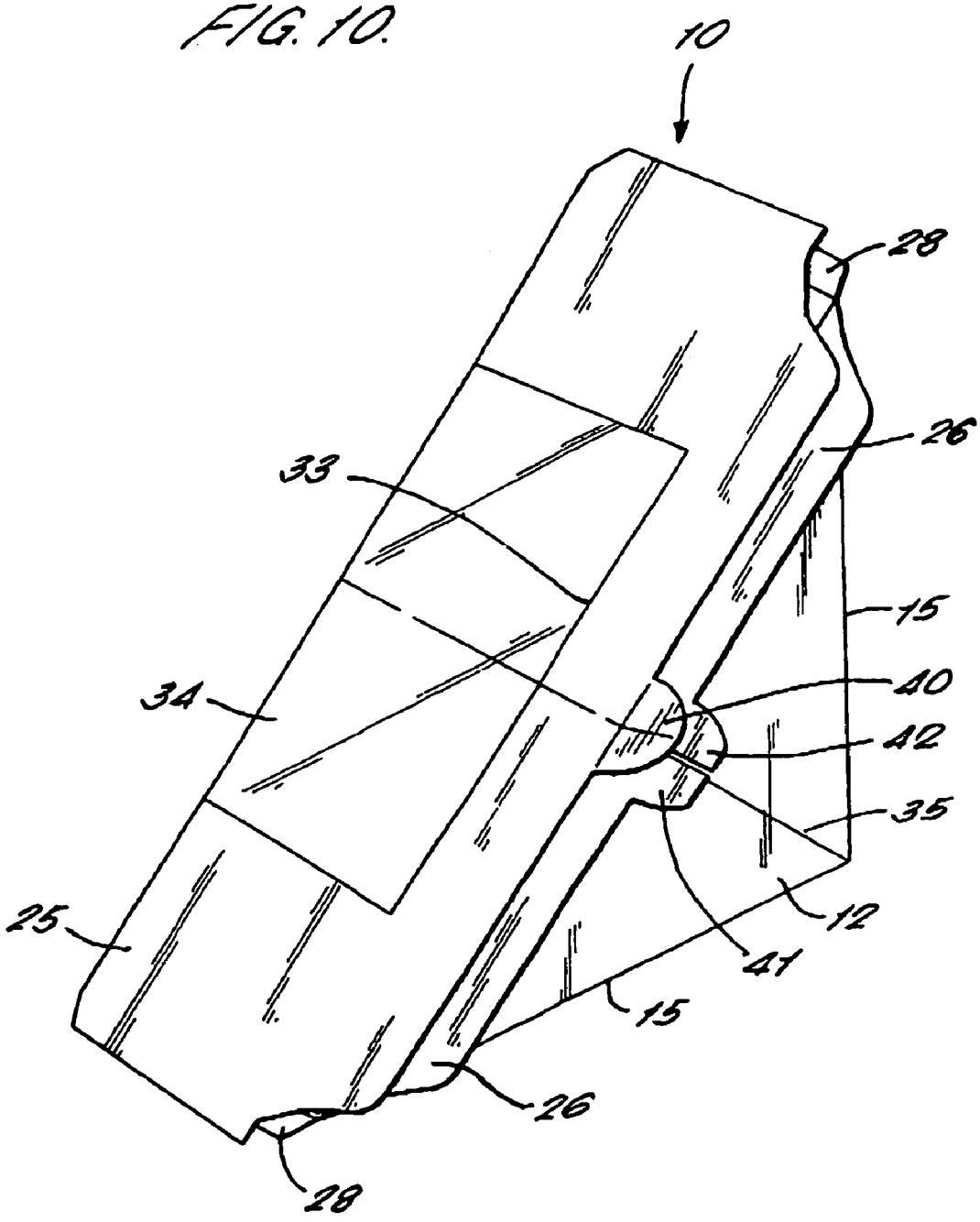
FIG. 10 is a perspective view of a carton for a diagonally cut sandwich stack with a lid of the carton folded over ready for heat sealing to flanges encircling the opening into the carton.
Figure 11:
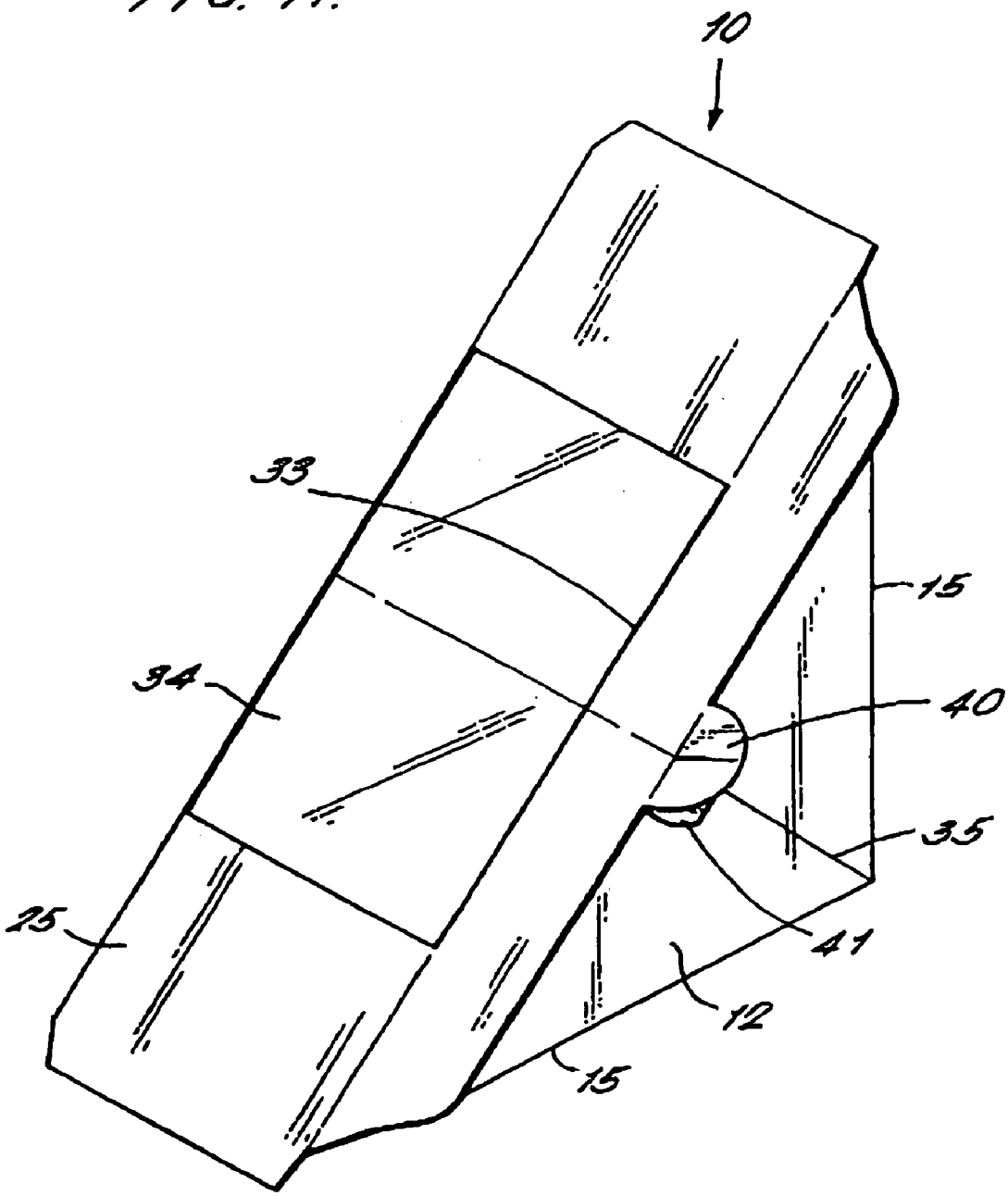
FIG. 11 is a similar view to FIG. 10 showing the lid heat sealed to the flanges encircling the carton but with release tabs on the lid and flange not secured together.
Figure 12:
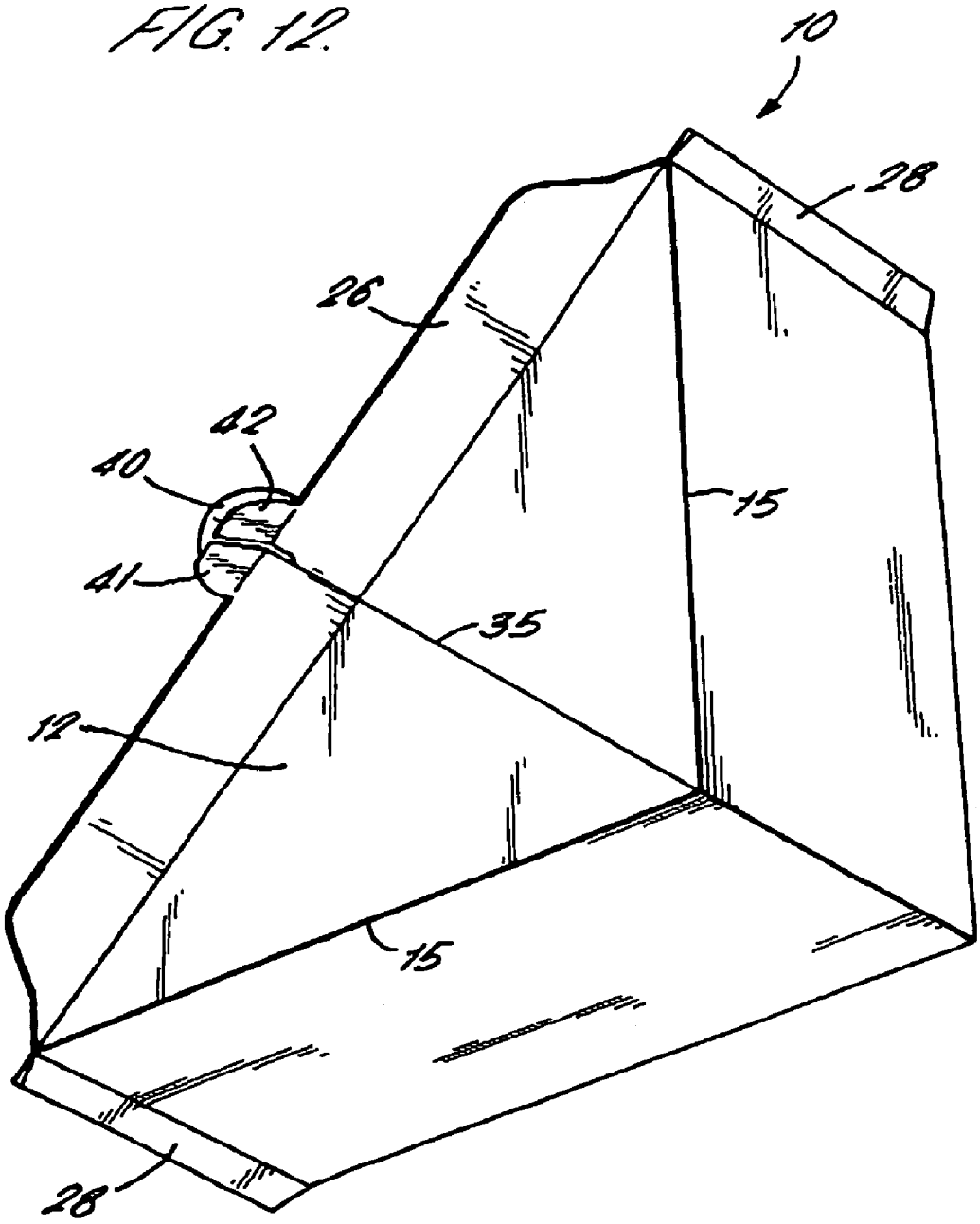
FIG. 12 is a similar view to FIG. 10 taken from the underside of the carton.

The carton shown in FIGS. 10 to 12 of the drawings is similar to the carton 10 shown in FIG. 9 above except that tab 40 on lid 25 and tabs 41 and 42 on flange parts 26 are not heat sealed together. Thus tab 40 can be separated from tabs 41 and 42 when the carton is to be opened by manually pulling the tabs apart. The heat seal between the lid and the flanges encircling the opening to the carton is thus severed and the lid of the carton opened. The arrangement is otherwise similar to that described in our Application No. 0228792.8.

Figure 13:
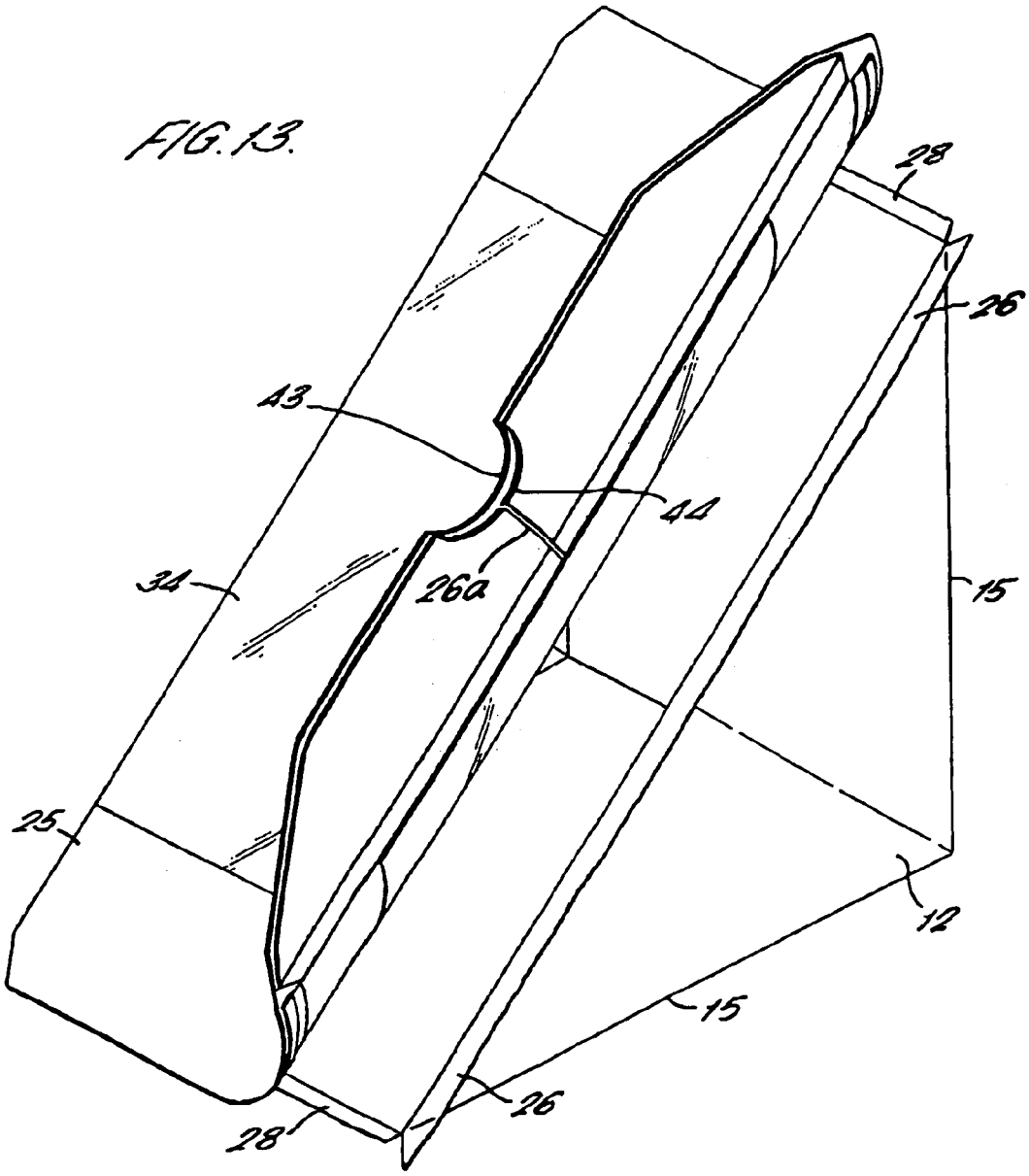
FIGS. 13 to 15 show yet a further embodiment.
Figure 14:
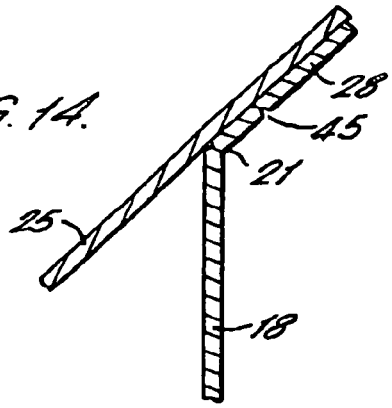
Figure 15:
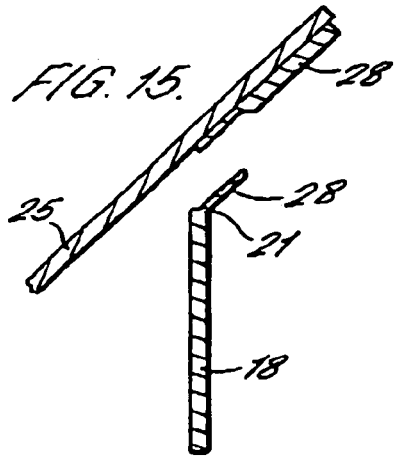

A further modified construction of the carton will now be described with reference to FIGS. 13 to 15. The arrangement shown is generally similar to that of FIG. 9. In the modified arrangement, the tabs 40, 41 and 42 are all omitted and the lid 25 has a semi-circular cut-out 43 centrally positioned along its free edge and flange 26 has a similar cut-out 44. The lid 25 of the carton is heat-sealed to the out-turned flanges 26 and 28 encircling the opening into the carton by a heat-sealing as before but in this case a partial severing arrangement known as "Concora" is also used. Special combined heat sealing/cutting dies created in the flanges 26 and 28 partially sever lines of cut 45 as the lid is heat-sealed to the flanges to either side of the cut lines. One of the lines of cut in one of the flanges 28 can be seen in FIG. 14. In addition a narrow slot 26*a* is formed at the centre of the flange 26 to promote separation of the lid from the flange. When the lid is pulled as indicated in FIG. 13 to open the carton, the flanges 26 and 28 split at the lines of cut 45 as indicated in FIG. 15 to allow the lid to be opened. The arrangement is otherwise similar to that of FIG. 9.

Figure 2:
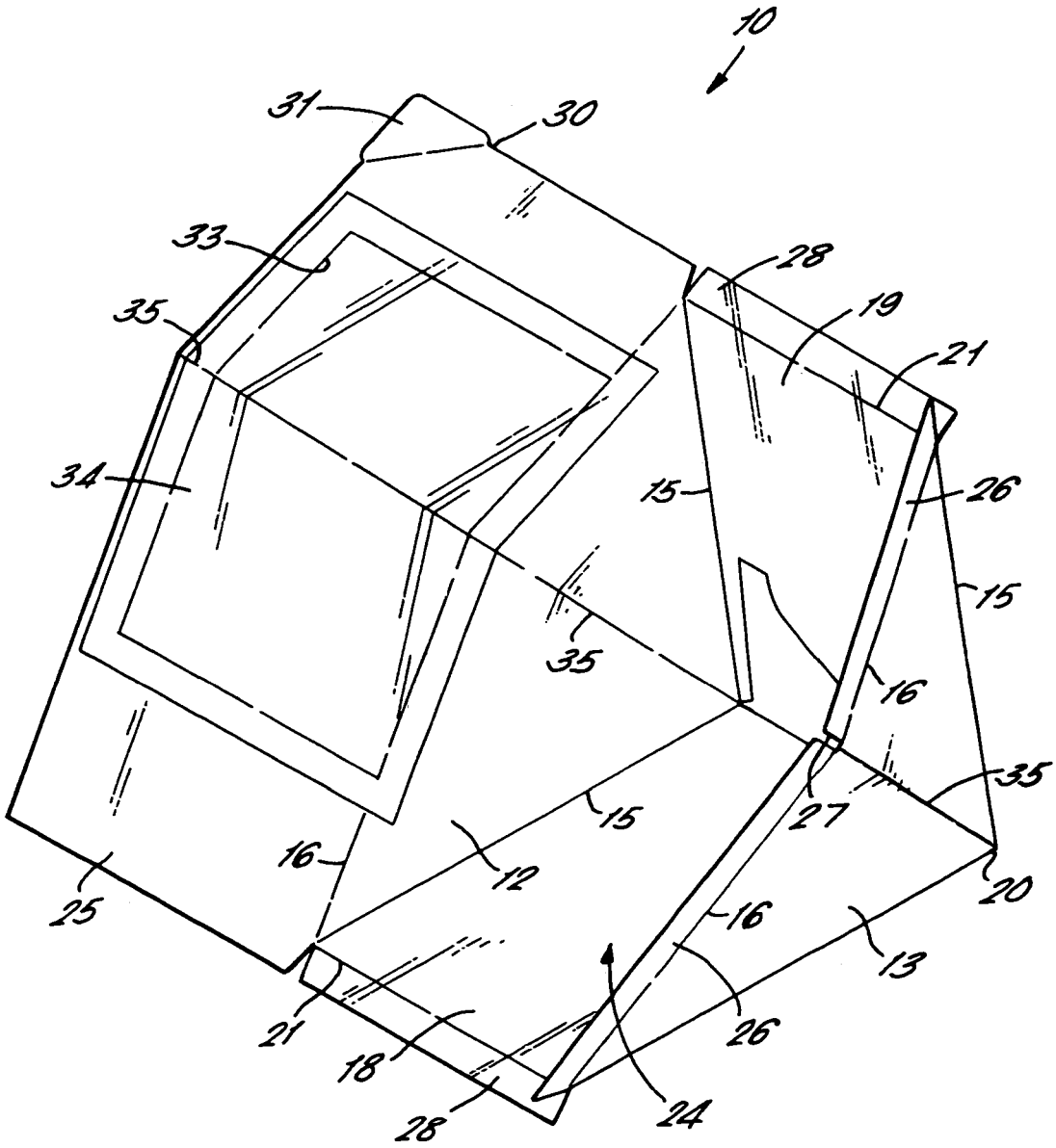
FIG. 2 is a similar view to FIG. 1 showing the lid in the open position and the end walls of the container bowed.
Figure 3:
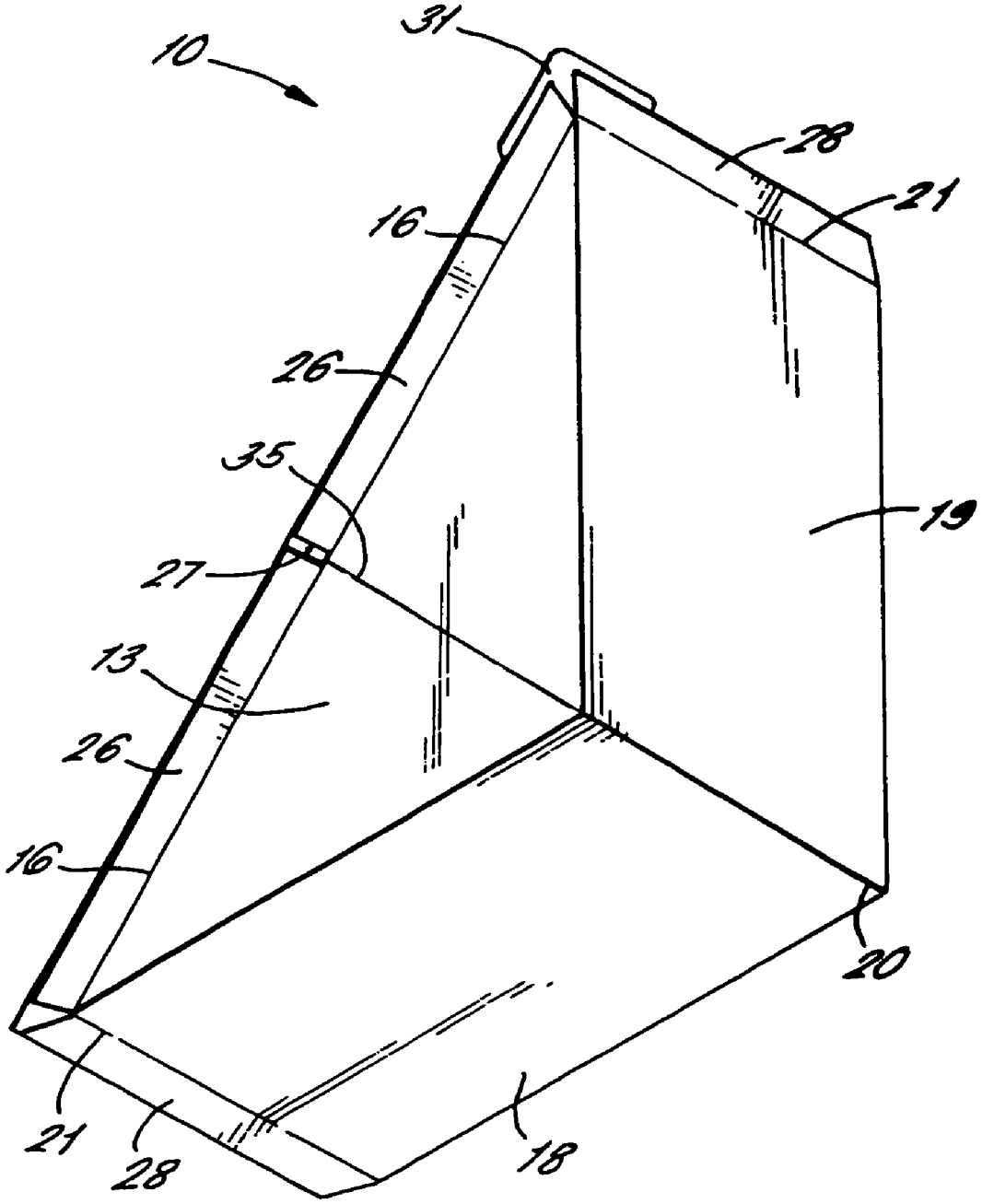
FIG. 3 is a rear perspective view of the container with the lid closed.
Figure 16:
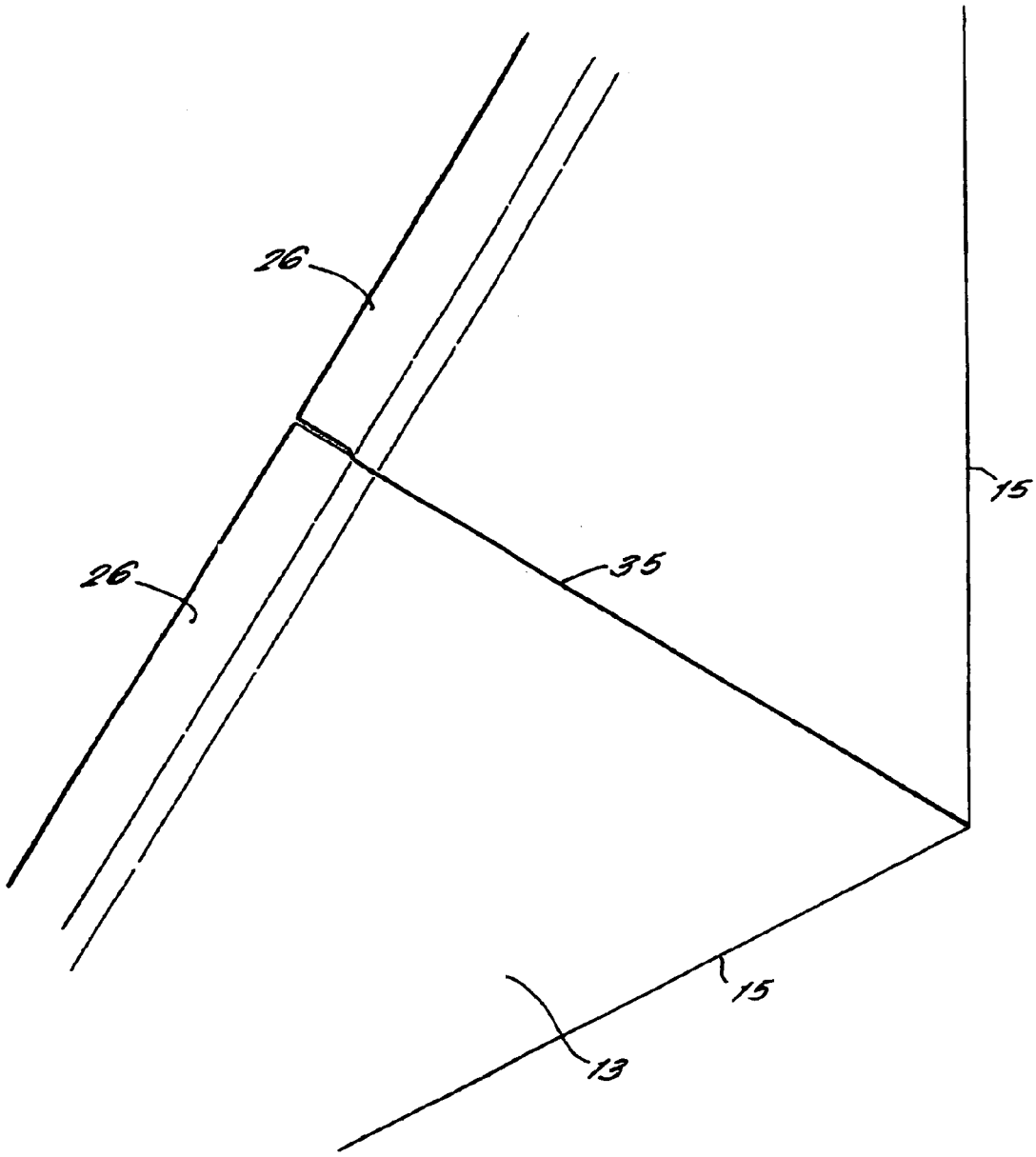
FIG. 16 is a modified version of the arrangement shown in FIGS. 1 to 3.

Reference is now made to FIG. 16 of the drawings which shows a modified version of the pack of FIGS. 1 to 3 described above. The "Concora" system previously described for securing the lid to the flanges in the arrangement of FIGS. 13 to 15 is used in the arrangement of FIG. 16 for securing the lid to the flanges 26 and 28 to facilitate the separation of the lid from the flanges. To that end, the flanges 26 and 28 are formed with dual parallel lines of partial sever and the corresponding lines of indentation on the undersides of the flanges can be seen at 21 and 21*a*. Line 21 also provides the hinge line between the flanges and container wall. When the lid of the container is torn open, the flanges sever along the lines 21/21*a* as described with reference to FIG. 13 above.

A further feature of the pack shown in FIG. 16 is that the side wall 13 is formed from two triangular wall portions 13*a* and 13*b* which meet at the hinge line 35. The wall portion 13*a* has an integral tab (not shown) extending beyond the hinge line 35 behind the second wall portion 13*b*, the tab being adhered to the back of the wall portion 13*b* to secure the wall portions together. The tab extends along the third line 35 up to the hinge line 21 but does not extend into the flanges 26*a* and 26*b*. The portion of flange 26*b* between lines of indentation 21 and 21*a* is formed with a slight extension or projection 50 which overlaps with the adjacent portion of the flange 26*a* to assist in providing a hermetic seal with the lid when the pack is closed. Beyond the line of indentation 21*a*, the flanges 26*a* and 26*b* have a slight gap indicated at 51.

Figure 17:
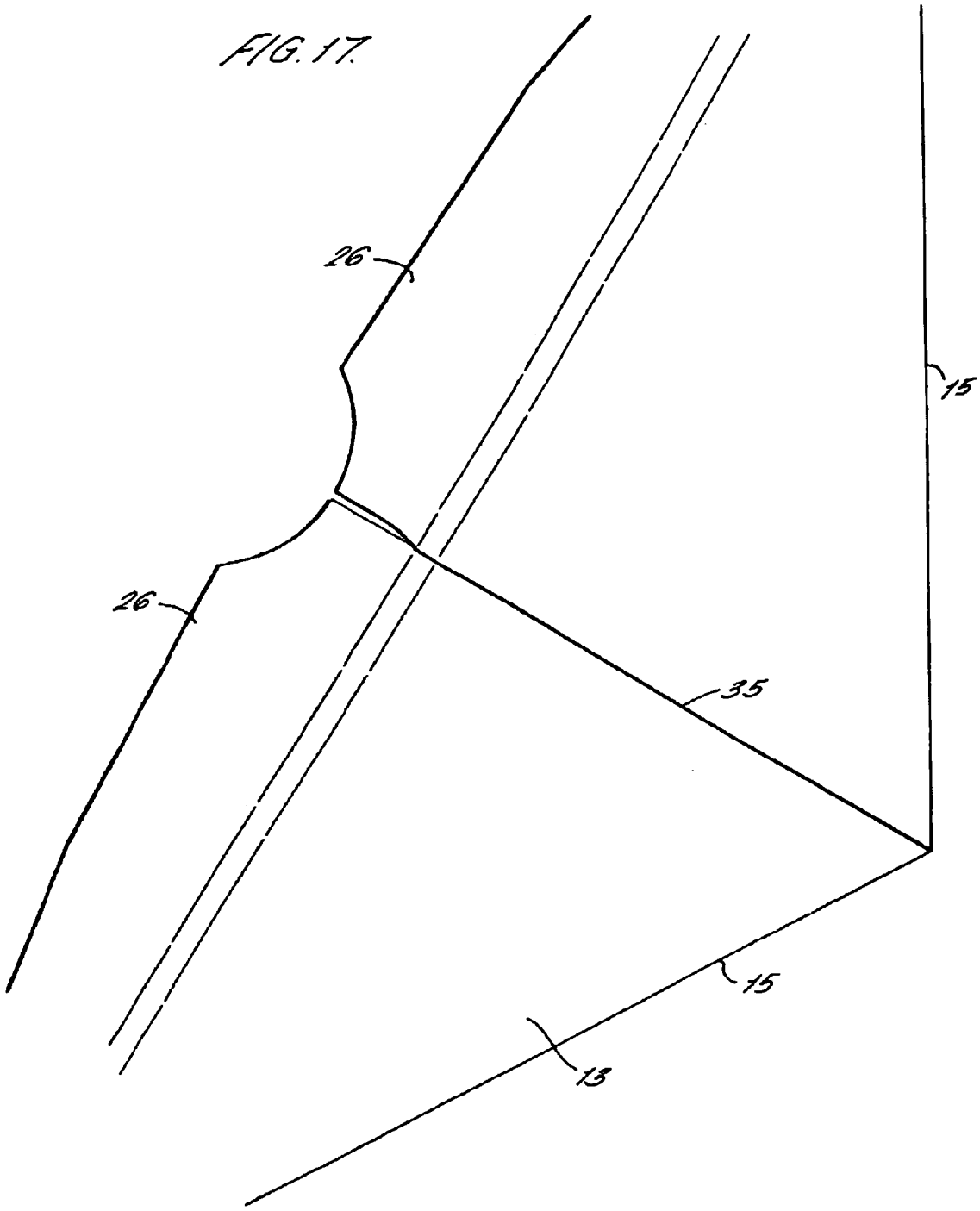
FIG. 17 is a modified version of the arrangement shown in FIGS. 13 to 15.

FIG. 17 shows a further modification to the pack of FIGS. 13 to 15 in which side wall 13 is formed in a similar manner to that described with reference to FIG. 16 above. Thus, the wall 13 is formed in two parts 13, 13*a* with a tab on part 13 which is adhered behind part 13*b*. The portion of flange 26*b* between the hinge line 21 and parallel line 21*a* is extended slightly at 51 to overlap with the adjacent portion of flange 26*a* again to assist in creating a hermetic seal for the pack when the lid is closed. The remaining portions of the flanges 26*a* and 26*b* are spaced slightly apart to provide a slit 51 as before.

The invention claimed is:

1. A carton for a diagonally cut sandwich or like foodstuff formed from a blank of card having a heat sealable coating on one surface and having triangular end walls connected by rectangular side walls to form a triangular prism-shaped container such that the surface having the heat sealable coating is on the inside of the container, one side wall of the container being hinged to another of said walls of the container to provide an opening for insertion/removal of foodstuff and to form a lid for closing the opening, the remaining edges of the opening of the container have out-turned flanges and the periphery of the lid overlying the out-turned flanges encircling the opening when the lid is in the closed position, whereby the periphery of the inside of the lid can be bonded to the flanges to seal the contents of the carton by applying heat, wherein the lid is hinged to the base of one of the triangular end walls, and the periphery of the lid is bonded to the out-turned flanges of the adjacent side walls and opposite end wall of the container.

2. A carton as claimed in claim 1, wherein the lid is formed with a projecting tab extending beyond the out-turned flanges of the opening to enable the lid to be separated from the out-turned flanges to which it is bonded to open the container.

3. A carton as claimed in claim 1, wherein a corner of the lid remote from the hinge is formed with a projecting tab to be grasped for opening the lid.

4. A carton as claimed in claim 1, wherein the lid has a window extending at least part of the length of the lid with a clear plastics film extending across the window and sealed to the underside of the lid to enable the contents of the container to be viewed.

5. A carton as claimed in claim 1, wherein the triangular end walls of the carton are formed with fold lines extending from the apices of the opposing bases to enable the container to be folded flat for storage prior to use.

6. A carton as claimed in claim 5 in which the lid is hinged to one triangular end wall of the container, wherein the crease extends through that said one end wall to enable said end wall to be folded flat also extends through the lid to enable the lid to fold flat with the side wall.

7. A carton as claimed in claim 5, wherein said fold lines bisect the end walls of the container.

8. A carton as claimed in claim 1 wherein the heat sealable card from which the container is formed has a coating on its inside face formed from at least one coating selected from the group consisting of polyethylene, a polyester, polypropylene, and acrylic.

* * * * *